US009358774B1

(12) United States Patent
Niswonger

(10) Patent No.: US 9,358,774 B1
(45) Date of Patent: Jun. 7, 2016

(54) METHOD OF TENSIONING A SCREEN FABRIC ON A FRAME

(71) Applicant: John O. H. Niswonger, Calabasas, CA (US)

(72) Inventor: John O. H. Niswonger, Calabasas, CA (US)

( * ) Notice: Subject to any disclaimer, the term of this patent is extended or adjusted under 35 U.S.C. 154(b) by 0 days.

(21) Appl. No.: 14/677,994

(22) Filed: Apr. 3, 2015

Related U.S. Application Data

(63) Continuation of application No. 13/909,088, filed on Jun. 4, 2013, now Pat. No. 8,997,648, which is a continuation of application No. 12/849,805, filed on Aug. 3, 2010, now Pat. No. 8,453,566, application No. 14/677,994, which is a continuation-in-part of application No. 14/525,221, filed on Oct. 28, 2014, now abandoned, which is a continuation of application No. 14/041,587, filed on Sep. 30, 2013, now Pat. No. 8,869,694, which is a continuation of application No. 13/651,471, filed on Oct. 15, 2012, now Pat. No. 8,544,384, which is a continuation of application No. 12/821,154, filed on Jun. 23, 2010, now Pat. No. 8,286,552, application No. 14/677,994, which is a continuation-in-part of application No. 14/525,222, filed on Oct. 28, 2014, which is a continuation of application No. 14/016,231, filed on Sep. 3, 2013, now Pat. No. 8,869,693, which is a continuation of application No. 13/550,852, filed on Jul. 17, 2012, now Pat. No. 8,522,681, which is a continuation of application No. 12/409,522, filed on Mar. 24, 2009, now Pat. No. 8,220,387.

(60) Provisional application No. 61/231,012, filed on Aug. 3, 2009, provisional application No. 61/312,671, filed on Mar. 11, 2010, provisional application No. 61/370,430, filed on Aug. 3, 2010, provisional application No. 61/219,408, filed on Jun. 23, 2009, provisional application No. 61/130,362, filed on May 31, 2008.

(51) Int. Cl.
*B41F 15/34* (2006.01)

(52) U.S. Cl.
CPC ..... *B41F 15/34* (2013.01)

(58) Field of Classification Search
CPC ..... B41F 15/34; B41F 15/36; B41F 15/0813; B05C 17/06; B05C 17/08; B41N 1/24; B41P 2215/12
USPC ..... 101/127, 127.1, 128.1, 129; 38/102.1, 38/102.2, 102.3, 102.5, 102.7, 102.91; 160/378, 379, 380, 381
See application file for complete search history.

(56) References Cited

U.S. PATENT DOCUMENTS

| | | | | | |
|---|---|---|---|---|---|
| 2,854,922 | A * | 10/1958 | Leibenguth | B41F 15/36 | 101/127.1 |
| 2,894,455 | A * | 7/1959 | Lambert | B41F 15/36 | 101/127.1 |
| 3,987,835 | A * | 10/1976 | Bloomfield | A44B 19/16 | 101/127.1 |
| 4,041,861 | A * | 8/1977 | Alter | B41F 15/36 | 101/127.1 |
| 2008/0235999 | A1 * | 10/2008 | Larson | B41F 15/36 | 38/102.4 |

*Primary Examiner* — Leslie J Evanisko
(74) *Attorney, Agent, or Firm* — Ronald L. Rohde

(57) ABSTRACT

A system for attaching mesh to a frame and applying tension to the mesh is described. The system includes a locking strip slot in a movable frame member that permits mesh and an attached locking strip to be inserted into the slot from the top. The locking strip may be asymmetric. The system further includes a rigid frame that can hold the movable frame member under tension. The system also includes gripping the movable frame member at the locking strip slot to apply tension to the mesh. A simple hand tool may be used for engaging the locking strip slot and leveraging against the rigid portion of the frame to apply the tension. A simple hand tool may be used for separating the movable frame member from the rigid frame to remove the mesh.

12 Claims, 15 Drawing Sheets

METHOD OF TENSIONING A SCREEN FABRIC ON A FRAME

BACKGROUND

1. Field of the Application

The present application relates generally to a silkscreen apparatus, and more particularly to a frame for supporting a screen-printing mesh.

2. Description of Related Art

Silkscreen printing has been used for centuries. The terms "screen," "mesh," "screen-printing mesh," and "silkscreen" are generally used interchangeably. Historically, silk was used as a screen-printing mesh. Presently, materials for screen-printing mesh include polyester, nylon, or stainless steel, plastics, fabric, metals, paper, animal, plant products, synthetic threads, and a laminated combination of these materials and/or various emulsions.

Generally, tensioning systems for mounting screen-printing mesh on frames are capable of handling mesh across the wide range of weight and texture. One method for tensioning and using mesh is to glue mesh to a frame while the mesh is held under tension. Unfortunately, the glues can degrade due to exposure to chemicals during printing. Moreover, stretched frames take up space during storage. Removing mesh for reuse of the frame destroys the mesh and typically involves the use of environmentally hazardous solvents. Some of these glues and solvents are presently being outlawed in various jurisdictions and may someday become unavailable for use anywhere.

Reusable frames are also used for tensioning mesh. One type of reusable frame includes a roller that has a longitudinal groove in the shape of an inverted "T" to hold the mesh. A locking strip is used to secure the fabric into the groove. The fabric is pushed into the groove from the top. The locking strip is inserted into the groove from an end of the groove and pushed or pulled to slide it lengthwise through the groove to secure the fabric. Removing mesh for reuse of the frame involves extracting the locking strip from the groove by sliding it the lengthwise out of an end of the groove to release the fabric. Unfortunately, it is difficult to load the fabric evenly and work the locking strip along the length of the groove because the locking strip catches on the fabric during insertion and removal.

Another type of reusable frame has a rigid frame with grooves in the top surface and a movable piece that has complimentary grooves in the bottom surface. The grooves in the rigid frame hold the movable piece under tension. The movable piece also has two inverted "T" grooves in the top surface. One inverted "T" groove is attached to mesh and the other is attached to an apparatus for stretching the mesh. Unfortunately, the stretching apparatus is complex, expensive, bulky, heavy, and slow, and is generally mounted to a table or fixed surface. Attaching the second inverted "T" groove to the stretching apparatus, stretching the mesh, and then releasing the second "T" groove are cumbersome operations that take substantial time and complicated manipulations. The resulting stretched frame is heavy.

SUMMARY

The above problem of attaching mesh to a frame under tension may be solved by an asymmetric locking strip slot in a movable frame member that permits the mesh and locking strip to be inserted into the slot from the top, and a rigid frame that can hold the movable frame member under tension. The above problem of stretching a screen on a frame may be solved by gripping the locking strip slot of a movable frame member into which mesh and locking strip have been inserted, and pulling on the movable frame member using the locking strip slot to apply tension to the mesh.

A simple hand tool for stretching the mesh on the frame includes a griping portion, a bearing portion, and an optional hinge between the gripping portion and the bearing portion. The gripping portion may be used for gripping the locking strip slot and pulling on the movable frame member to stretch the mesh. The bearing portion may be used for leveraging against the rigid frame to pull on the gripping portion. The hinge may be used to maintain a angle between the gripping portion and the locking strip slot during translation of the movable frame member. An offset of the mesh from the gripping surface can reduce or avoid tearing of the mesh by the gripping portion.

A simple hand tool for removing the mesh from the frame includes a gripping portion and a wedge. The gripping portion of the removal tool may be used for gripping the locking strip slot and pulling to release the movable frame member from the frame under tension. The wedge may be inserted between angled surfaces of the movable frame member and the frame while pulling to separate and release the movable frame member from the frame. An optional catch may be used for preventing the released movable frame member from launching under tension of the mesh on the movable frame member. The mesh may be removed from the movable frame member once tension on the mesh is released.

The present disclosure includes a frame for stretching screen fabric. The frame comprises a rigid frame including a step and a side groove on an external side of the step and a movable frame member including an asymmetric locking strip slot and a projection configured to engage the side groove. The frame further comprises a ridge on the rigid frame between the step and the center of the frame. The ridge is configured to support the stretched screen fabric. In some embodiments, the rigid frame further includes a second step, and the movable frame member configured to suspend the screen fabric above the ridge when it is placed on the second step. The movable frame member may include an offset ridge that is configured to separate the screen fabric from an engagement surface of the locking strip slot. The rigid frame may include a tool bearing surface including a longitudinal groove on an external surface of the rigid frame. The longitudinal groove may be lower than the step. A tool may be used for griping the engagement surface and may levered against the tool bearing surface.

In some embodiments, the present disclosure includes system for tensioning a screen-printing panel on a frame. The system comprises a movable frame member that includes an asymmetric locking strip slot. The locking strip slot is configured to receive a locking strip from the top of the slot and hold the screen-printing panel using the locking strip. The system further includes a rigid frame that is configured to hold the movable frame member in a loading position while receiving the locking strip. The rigid frame is also configured to hold the movable frame member at a stretched position while the screen printing panel is under tension. The system may include a stretching tool for urging the movable frame member from the loading position to the stretched position. The stretching tool includes a gripping surface configured to engage a tool engagement surface in the locking strip slot. The stretching tool also includes a bearing surface configured to engage an external surface of the rigid frame for leveraging force to be applied to the gripping surface.

In some embodiments, method for tensioning a screen fabric on a frame includes inserting a locking strip attached to the screen fabric into a locking strip slot that is a part of a movable frame member and applying a force to the locking strip slot for stretching the screen fabric and translating the movable frame member from an insertion position to a stretched position. The method further includes holding the movable frame member at the stretched position using a rigid frame. The applied force may vertically translate the movable frame member from the insertion position on a first step to the stretched position on a second step.

BRIEF DESCRIPTION OF THE DRAWINGS

FIGS. 13A-12B are cross sections illustrating use of the tool of FIG. 9A to remove mesh.

DETAILED DESCRIPTION

Figure 1:
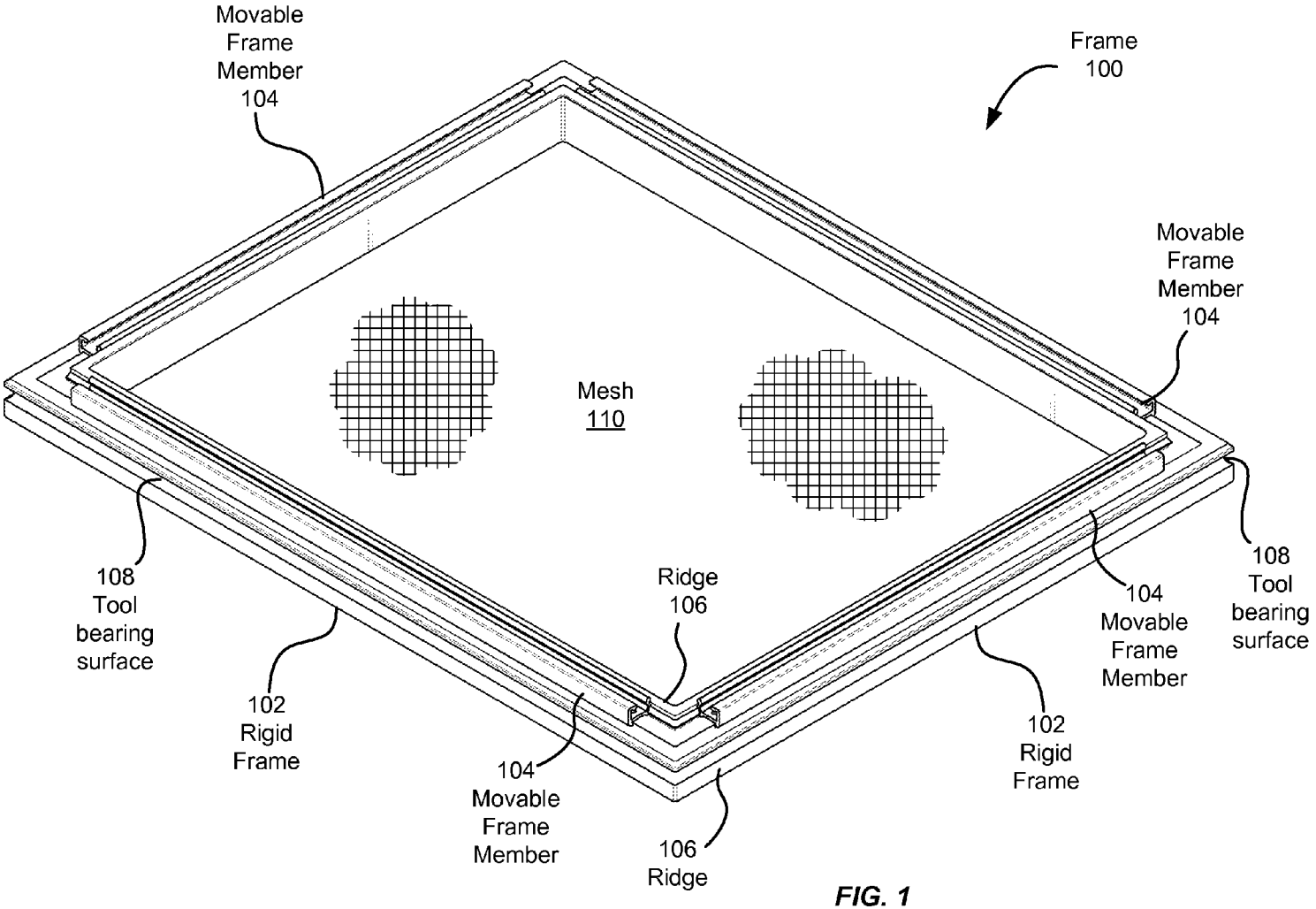
FIG. 1 is a perspective view of an embodiment of a frame for screen tensioning and printing, in accordance with aspects of the invention.
Figure 2A:
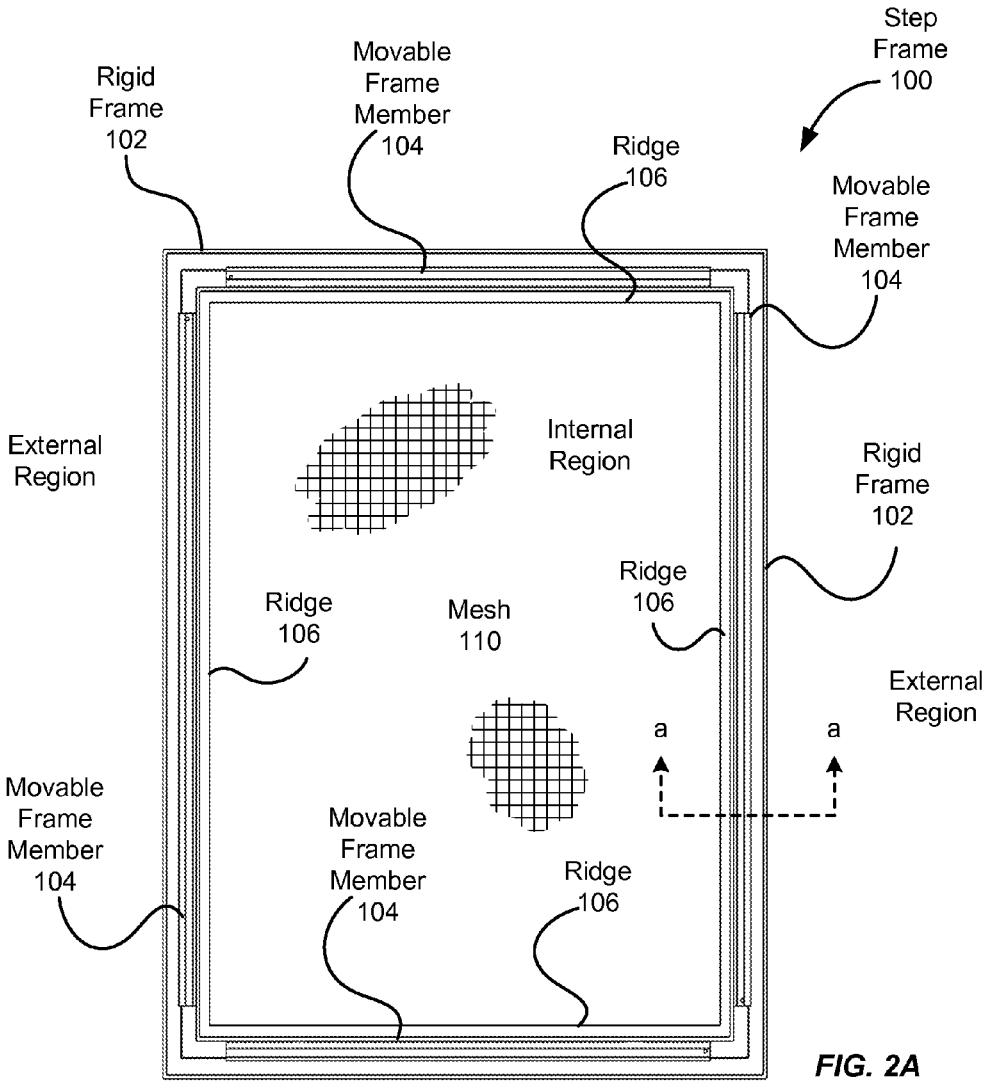
FIGS. 2A and 2B are a top plan view and a side elevation, respectively, of the frame of FIG. 1.
Figure 2B:
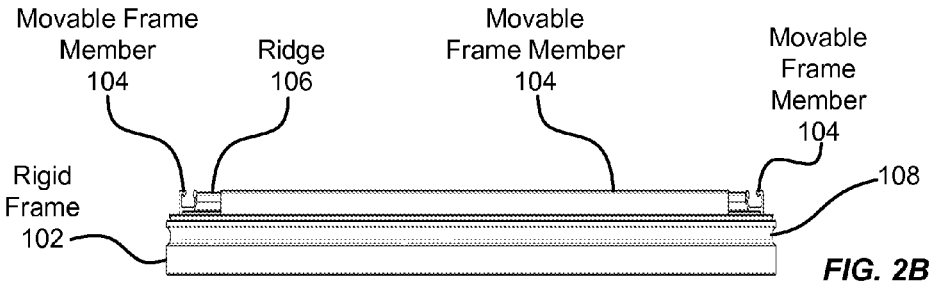

FIG. 1 is a perspective view of an embodiment of a frame 100 for screen tensioning and printing, in accordance with aspects of the invention. FIGS. 2A and 2B are a top plan view and a side elevation, respectively, of the frame 100 of FIG. 1. The frame 100 includes a rigid frame 102 and movable frame members 104. The frame 100 may be characterized as having an internal region or internal side and an external region or side. The internal region is bounded by the frame and includes the plane and center of the frame 100. The rigid frame 102 includes a ridge 106. The ridge illustrated in FIG. 1 is continuous around a periphery of the rigid frame 102 along an inner side and may separate the internal side of the frame 100 from the external side. The rigid frame further includes a tool bearing surface 108 comprising a groove disposed longitudinally along the external side of the rigid frame and substantially continuous around the periphery the rigid frame 102. Mesh 110 is suspended on the frame 100, generally in the internal region. The movable frame members 104 of FIG. 1 are on the external side of the ridge 106.

Figure 3:
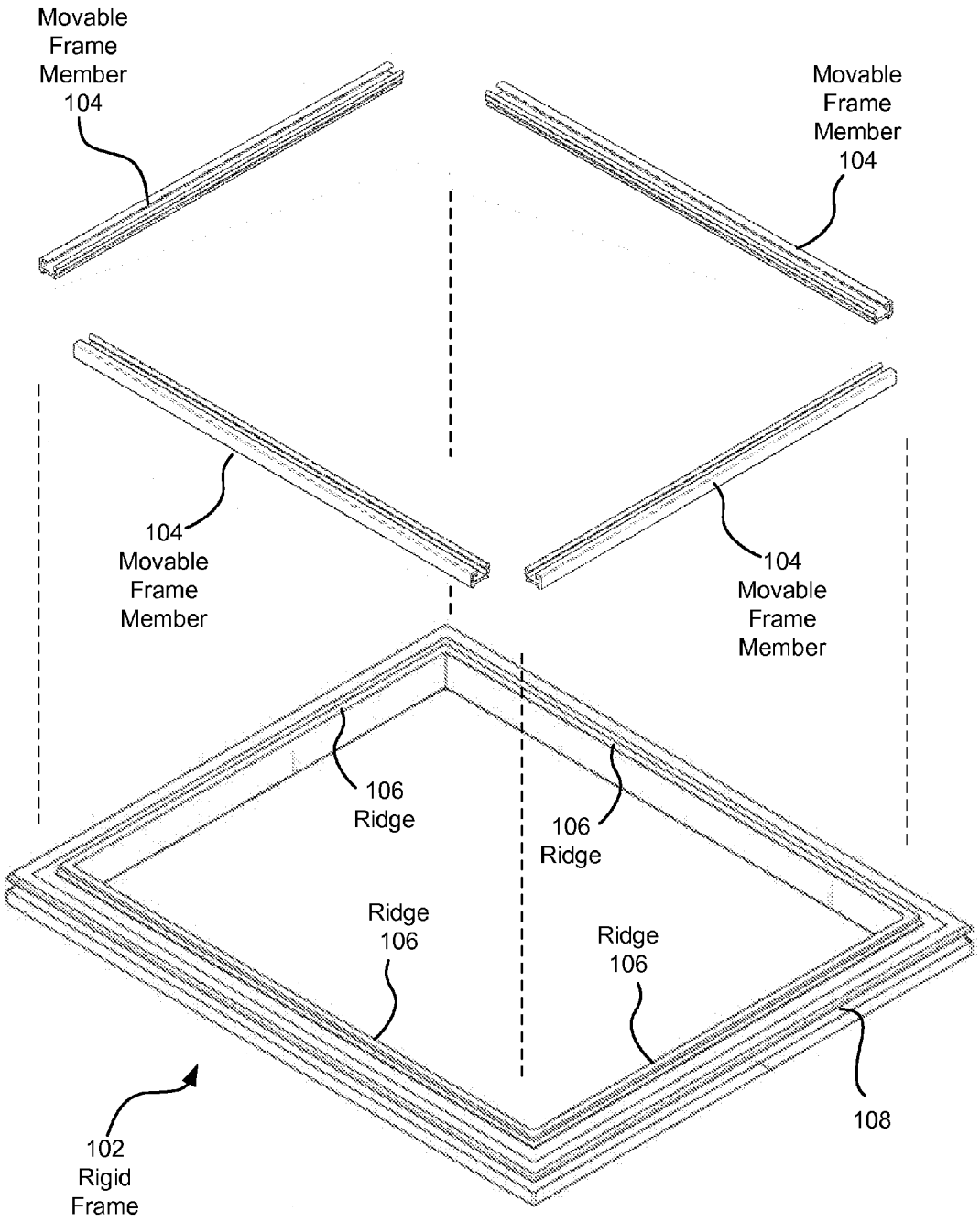
FIG. 3 is a perspective, exploded view of the frame of FIG. 1 illustrating a rigid frame and movable frame members.

FIG. 3 is a perspective, exploded view of the frame 100 of FIG. 1 illustrating the rigid frame 102 and the movable frame members 104. The mesh 110 is omitted from FIG. 3 for clarity. The movable frame members 104 are typically placed on the rigid frame 102 from the top. Generally, a panel of the mesh 110 is loaded onto the frame 100 and secured to the movable frame members 104 while they are in place on the rigid frame 102.

Figure 4A:
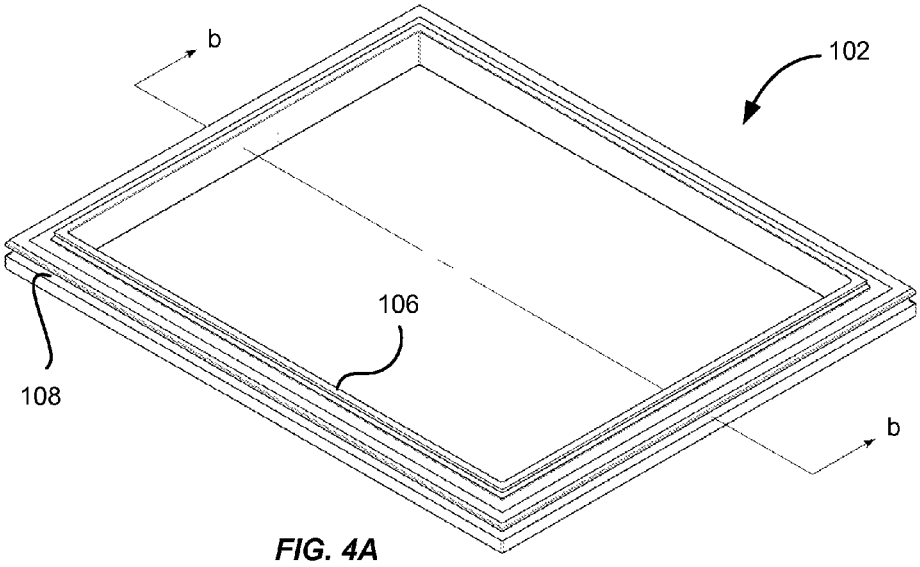
FIGS. 4A-4C are, respectively, a perspective view, a top plan view, and a bottom plan view of the rigid frame of FIG. 3.
Figure 4B:
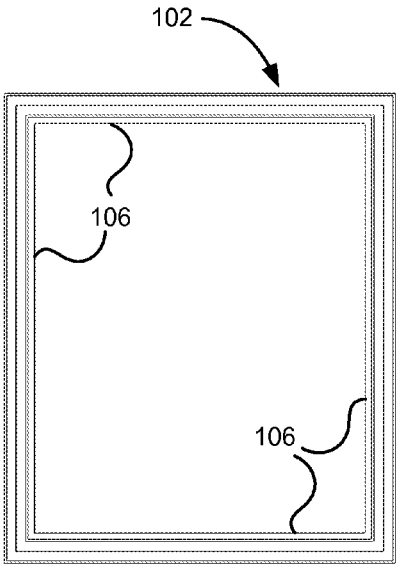
Figure 4C:
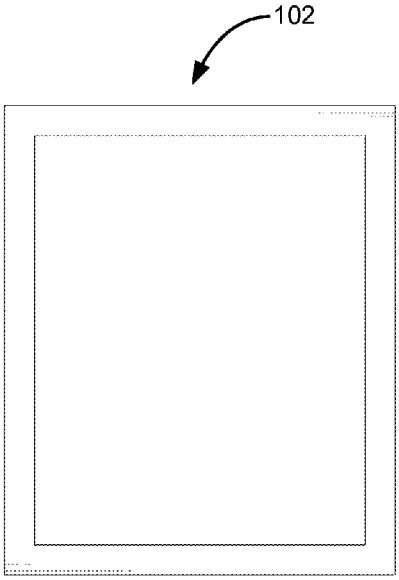
Figures 5A, 5B:
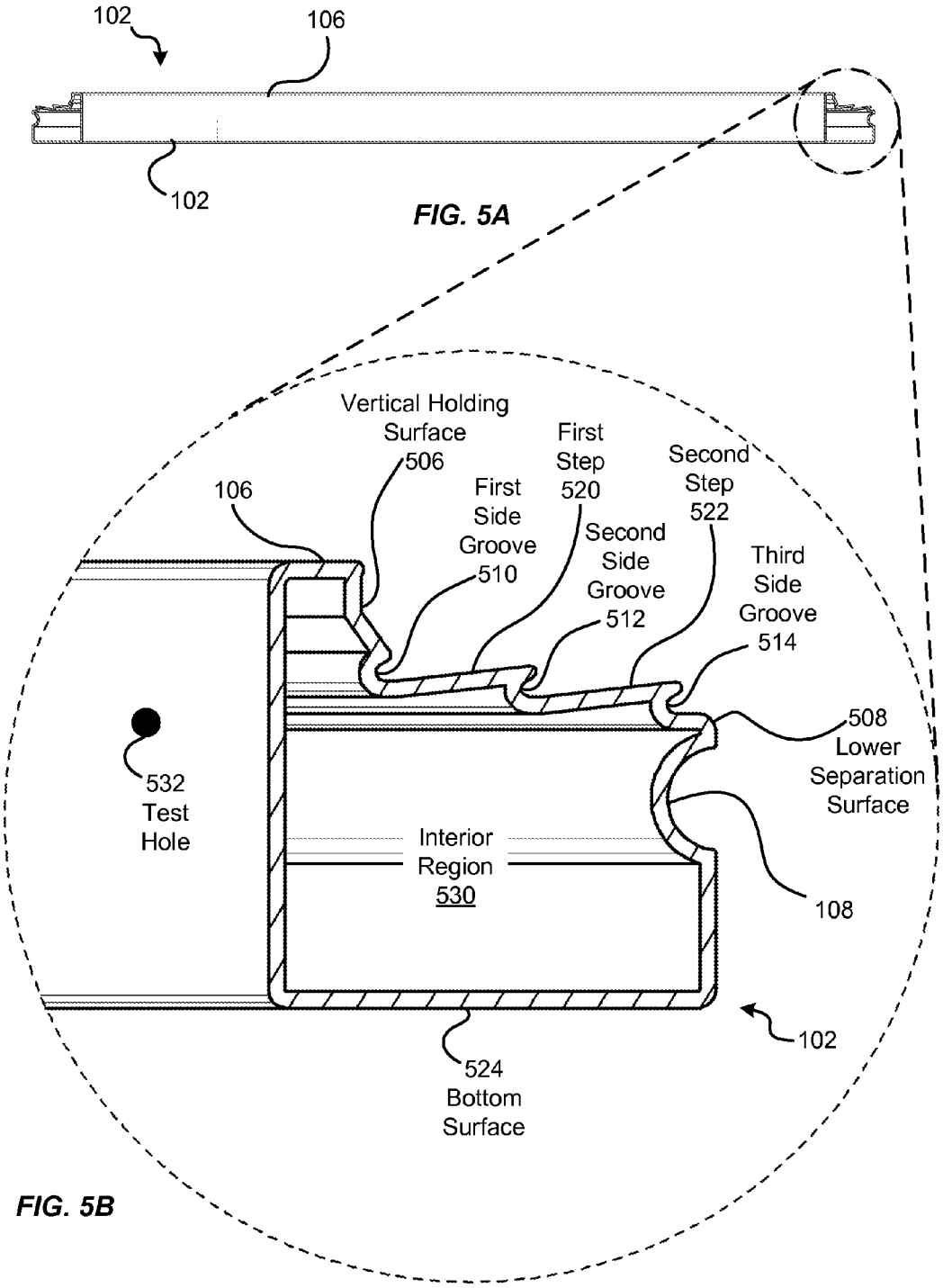
FIG. 5A is a cross section taken along line b-b of the rigid frame of FIG. 4A.
FIG. 5B is an enlarged, detailed view of a portion of the cross section of FIG. 5A indicated by a circle.

FIGS. 4A-4C are, respectively, a perspective view, a top plan view, and a bottom plan view of the rigid frame 102 of FIG. 3. FIG. 5A is a cross section taken along line b-b of the rigid frame 102 of FIG. 4A. FIG. 5B is an enlarged, detailed view of a portion of the cross section of FIG. 5A indicated by the circle. The rigid frame 102 may be constructed using hollow extrusions that are mitered and joined at the corners. In various embodiments, the corners are joined using welding, brazing, glue, inserts, and/or the like. Materials for fabricating the rigid frame 102 and/or the movable frame members 104 include metal, plastic, carbon fiber, and/or the like.

Referring to FIG. 5B, the rigid frame 102 may be leak tested using a test hole 532 tapped in a surface to pressurize an interior region 530 (see FIG. 5B). A leak may be indicated using a pressure gage. Soapy water may be applied externally to the rigid frame 102 while under pressure to detect a location of a leak. Upon completing the leak tests, the test hole 532 may be sealed, e.g., using silicone, latex, glue, a weld, a braze, a plug, and/or the like.

Referring to FIGS. 4A and 4B, the ridge 106 as illustrated therein is substantially continuous around the inside periphery of the rigid frame 102. The ridge 106 provides a bearing surface for supporting the mesh. The bearing surface generally defines a plane for the panel. The ridge further provides a taping surface. A continuous ridge is capable of retaining printing ink inside the printing region of the frame 100. The rigid frame 102 may be powder coated for reducing friction and ease in cleaning.

Referring to FIG. 5B, the ridge 106 comprises a vertical holding surface 506 and a groove disposed at the base of the external side of the ridge, namely the first side groove 510. The holding surface 506 is configured for holding the movable frame member 104 while loading a locking strip. The rigid frame 102 of FIG. 5B further comprises a first step 520 and a second step 522. The first step 520 is separated from the second step by a second side groove 512. The exterior side of the rigid frame 102 includes a third side groove 514 a lower separation surface 508 and the tool bearing surface 108. The side grooves 510-514 are useful for holding the movable frame member 104 to the rigid frame 102, either during loading of the mesh 110 or under tension. The first step 520 may be vertically offset above the second step 522. While, portions of the second step 522 may be at about the same level or higher than the first step 520, the second step 522 is generally lower than the first step 520. Substantially any point on the second step 522 is lower than a corresponding point on the first step 520. Thus, the mesh 110 may be loaded into the movable frame member 104 at a higher level on the first step 520 and held under tension on the second step 522 at a lower level, as will be discussed in additional detail below.

Figure 6A:
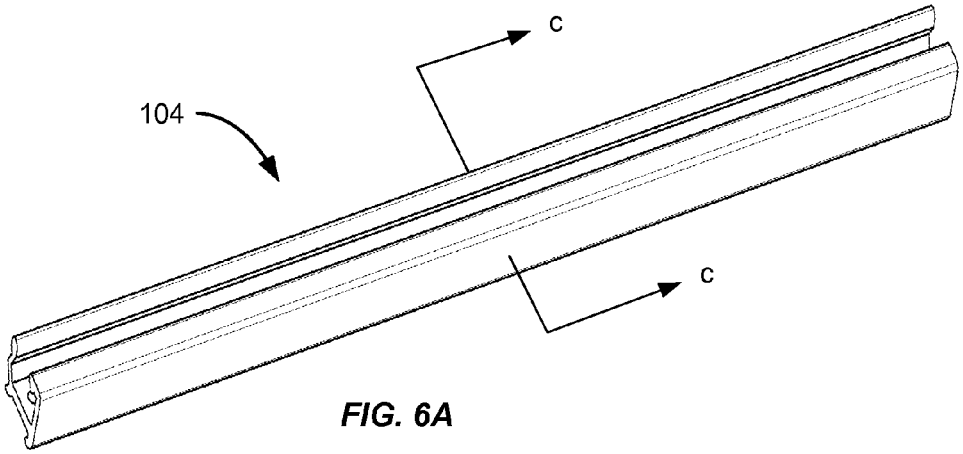
FIG. 6A is an enlarged perspective view of one of the movable frame members of FIG. 3.
Figure 6B:
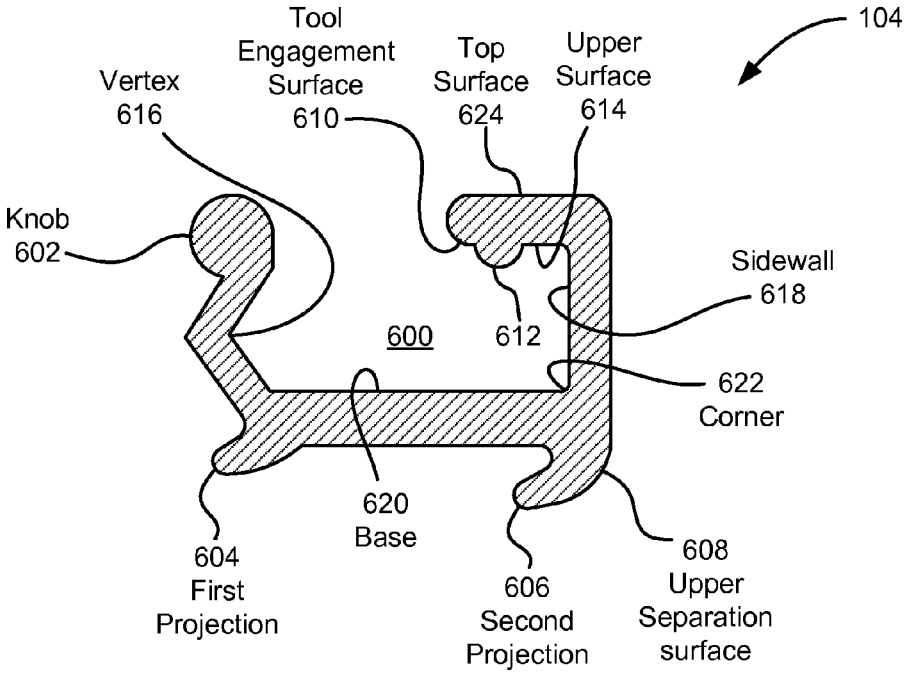
FIG. 6B is an enlarged cross section taken along line c-c of the movable frame member of FIG. 6A.

FIG. 6A is an enlarged perspective view of a movable frame member 104 of FIG. 3. FIG. 6B is an enlarged cross section taken along line c-c of the movable frame member 104 of FIG. 6A. The movable frame members 104 may be fabricated as extrusions. The movable frame member 104 may powder coated to reduce friction and for ease of cleaning and maintenance.

The movable frame member 104 of FIG. 6B includes a locking strip slot 600. The locking strip slot 600 is bounded by a knob 602, a vertex 616, a base 620, a sidewall 618, and an upper surface 614. The upper surface 614 includes a tool engagement surface 610 and offset ridge 612. A side chamber may be defined by the sidewall 618, the base 620 and a region below the upper surface 614, the offset ridge 612, and the tool engagement surface 610. The locking strip slot 600 of FIG. 6B is asymmetric in that a distance between the knob 602 and a corner 622 formed by the sidewall 618 and the base 620 is greater than a distance between the vertex 616 and the offset ridge 612. However, the locking strip slot may be symmetric, e.g., an inverted "T" slot.

Figure 7A:
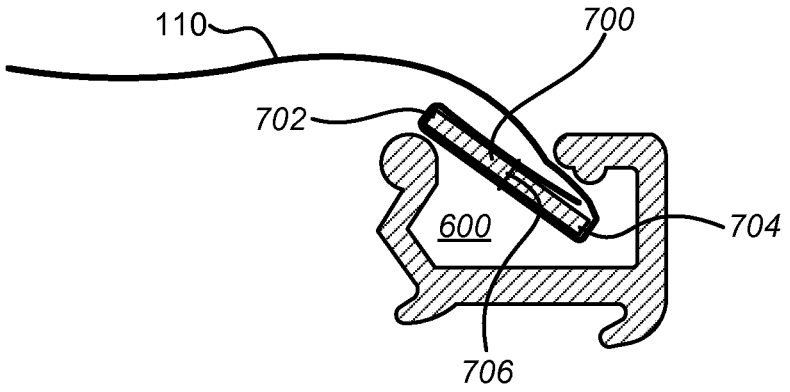
FIGS. 7A-7C illustrate insertion of a locking strip into a locking strip slot of the movable frame member of FIG. 6B.
Figure 7B:
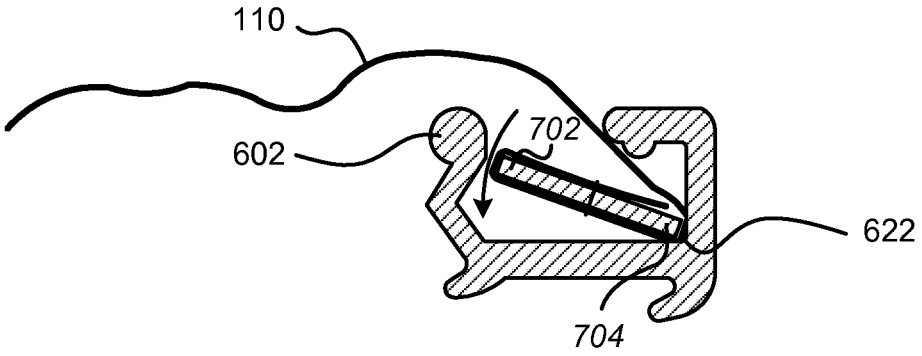
Figure 7C:
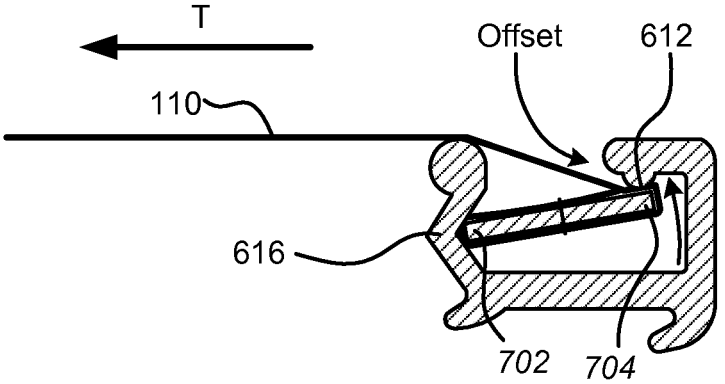

FIGS. 7A-7C illustrate insertion of a locking strip 700 into the locking strip slot 600 of the movable frame member 104 of FIG. 6B. The locking strip 700 may be inserted from the top of the locking strip slot 600 toward the corner 622 and rotated past the knob 602 and into place against the vertex 616. The locking strip 700 may be stitched to the mesh 110 using stitching 706 (See, e.g., U.S. patent application Ser. No. 12/821,154, and U.S. patent application Ser. No. 12/409,522). FIG. 7A illustrates a leading edge 704 of a locking strip 700 being inserted toward the locking strip slot 600. Referring to FIG. 7B, the leading edge 704 is pivoted near the corner 622 such that a trailing edge 702 of the locking strip 700 rotates into the locking strip slot 600 past the knob 602. In FIG. 7C, the trailing edge 702 is pivoted at the vertex 616 to rotate the leading edge 704 up against the upper surface 614 and/or the offset ridge 612. Thus, there is no need to slide the locking strip 700 into the locking strip slot 600 from an end.

Walls of the vertex 616 may guide the trailing edge 702 toward a point of the vertex. Tension (T) on the mesh 110 tends to urge the trailing edge 702 to slide along the walls of the vertex 616 into the point of the vertex 616. Thus, the vertex 616 functions to automatically position the trailing edge 702, i.e., provides a self centering function for the locking strip 700. The tension further urges the locking strip 700 to rotate up against the offset ridge 612 near leading edge 704. The tension on the mesh 110 then holds the trailing edge 702 against the vertex 616 and the leading edge 704 against upper surface 614 and/or the offset ridge 612. The offset ridge 612 may provide an offset between the mesh 110 and the tool engagement surface 610.

Referring to FIG. 6B, the movable frame member 104 further includes a first projection 604, a second projection 606, and an upper separation surface 608. The first projection 604 is configured to engage the first side groove 510 and the second side groove 512 as described elsewhere herein. The second projection 606 is configured to engage the second side groove 512 and the third side groove 514 as described elsewhere herein.

Figure 8A:
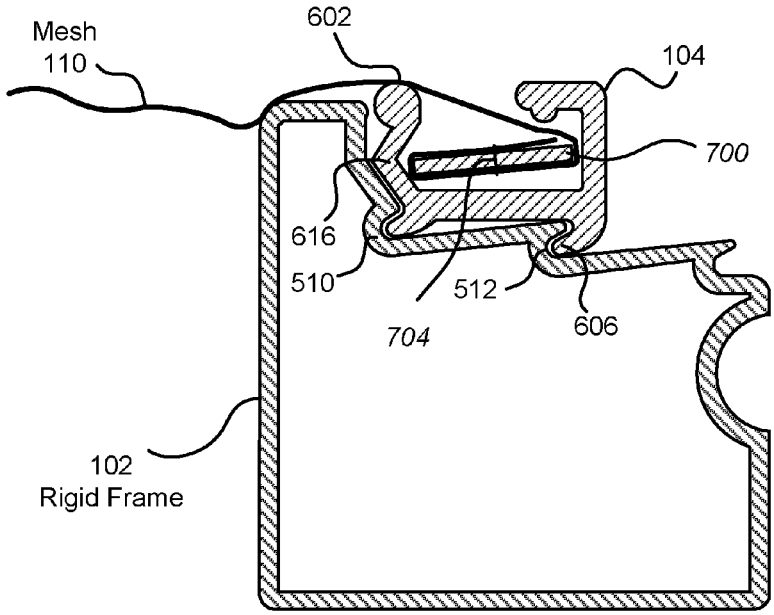
FIG. 8A is a cross section of the rigid frame taken along line a-a of FIG. 2A.
Figure 8B:
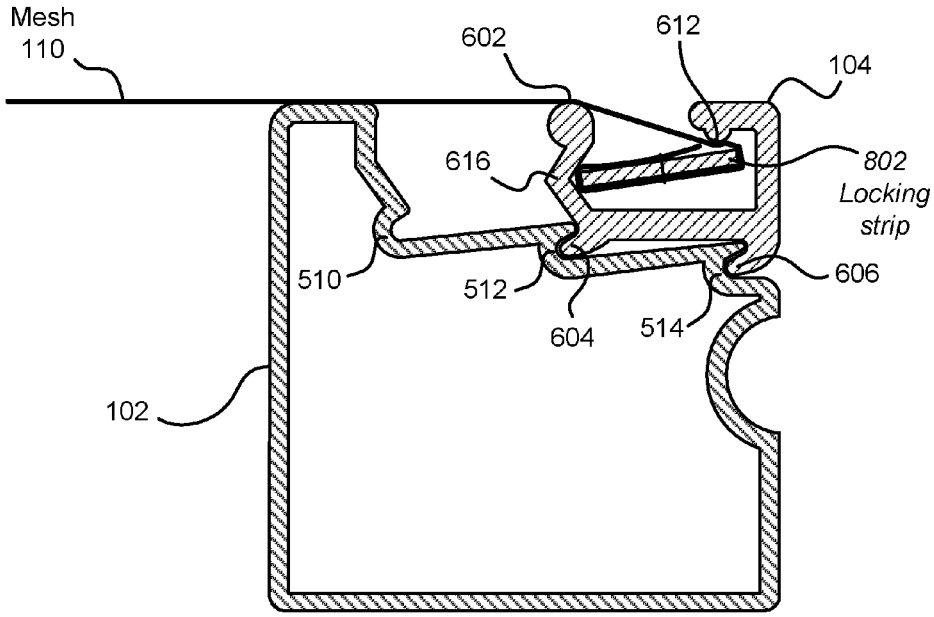
FIG. 8B illustrates the frame of FIG. 8A configured for applying tension to mesh.

FIG. 8A is a cross section of the frame 100 taken along line a-a of FIG. 2A. FIG. 8B illustrates the frame 100 of FIG. 8A configured for applying tension to the mesh 110. FIG. 8A differs from FIG. 8B in that the movable frame member 104 in FIG. 8B is in a stretched position on the rigid frame 102, whereas the movable frame member 104 in FIG. 8A is in a load position on the rigid frame 102. In the load position of FIG. 8A, the mesh 110 and locking strip 700 may be inserted into the locking strip slot 600 as illustrated in FIGS. 7A-7C. In FIG. 8A, first projection 604 is engaged in the first side groove 510 and the second projection 606 is engaged in the second side groove 512. This engagement allows for insertion of the mesh 110 and locking strip 700, and application of a loose tension to the mesh 110 without causing rotation of the movable frame member 104.

A force may be applied to the movable frame member 104 (see, e.g., FIGS. 12A-12B) to translate the movable frame member 104 from the load position on the first step 520 to the stretched position on the second step 522, thus, stretching the mesh 110. In some embodiments, the force is applied laterally and substantially symmetrically about a center of the movable frame member 104, as viewed from a top plan view. The movable frame member 104 is higher while disposed on the first step 520 than on the second step 522. On the first step 520, the knob 602 is above the top surface of the ridge 106. Under little or no tension, the knob 602 may suspend the mesh 110 above the ridge 106 to reduce dragging and friction between the mesh 110 and the ridge 106 during stretching. The radius of the knob 602 may also contribute to reducing tearing of the mesh 110 during stretching.

During translation, the movable frame member 104 moves to a lower position on the second step 522. The step down brings the first projection 604 into engagement with the second side groove 512 and brings the second projection into engagement with the third side groove 514. The two point engagement prevents rotation of the movable frame member 104 relative the rigid frame 102. The step down also brings the mesh 110 into contact with the top surface of the ridge 106 for support. The translation increases tension (T) on the mesh 110. Increased tension on the mesh 110 seats the trailing edge 702 of the locking strip 700 into the vertex 616 and induces a rotation of the leading edge 704 against the offset ridge 612 and/or the upper surface 614. The rotation of the locking strip 700 is resisted by the two point engagement. A pinching of the mesh 110 between the trailing edge 702 and the vertex 616 serves to secure the mesh 110 in the locking strip slot 600. Likewise, pinching of the mesh between the leading edge 704 and the offset ridge 612 and/or the upper surface 614 further serves to secure the mesh 110.

The configuration of the movable frame member 104 disposed at the second step 522 enhances mounting of the frame 100 in printing equipment. On the second step 522, the top of knob 602 of FIG. 8B is coplanar with the top of the ridge 106 and the top surface 624. This coplanar relationship presents a flat surface that enhances clamping of the frame 100 for mounting in screen-printing equipment (not illustrated). The bottom surface 524 may be parallel to a plane defined by the top of the ridge 106, the top of the knob 602, and the top surface 624. This parallel relationship further enhances clamping of the frame 100 for mounting in screen-printing equipment.

Figure 9A:
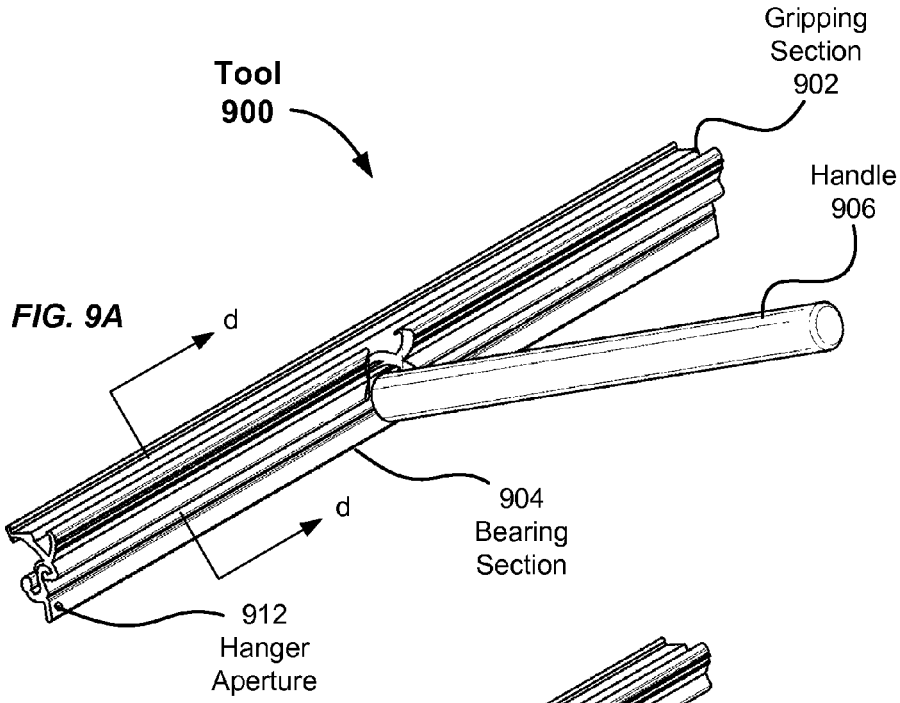
FIG. 9A is a perspective view of an embodiment of a tool for stretching and removing mesh from the frame of FIG. 1, in accordance with aspects of the invention.
Figure 9B:
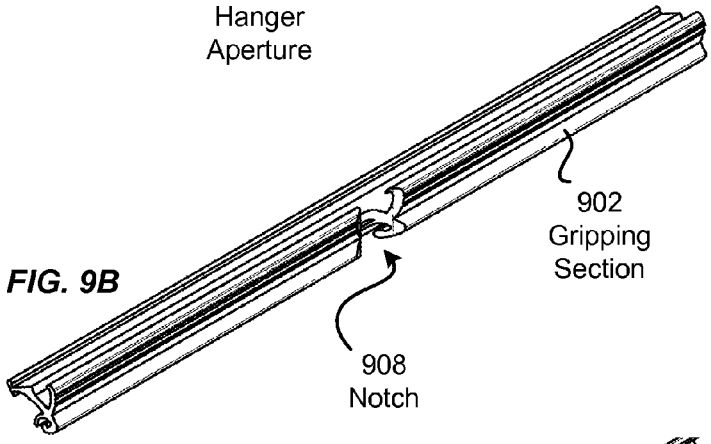
FIG. 9B is a perspective view of a gripping section of the tool of FIG. 9A.
Figure 9C:
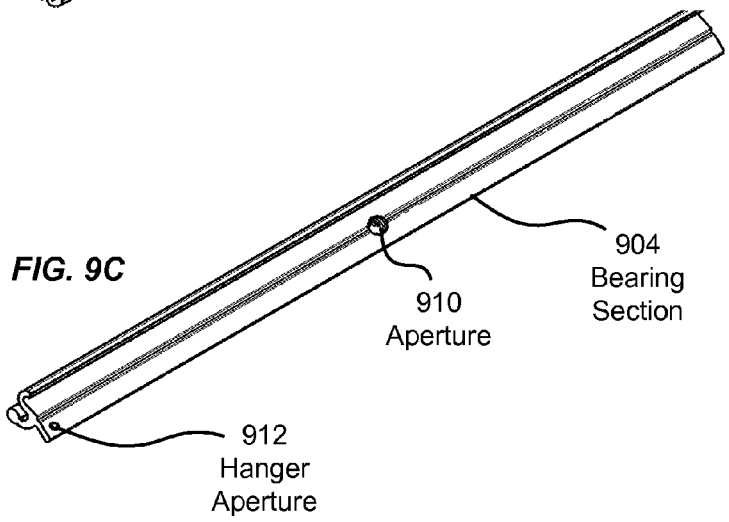
FIG. 9C is a perspective view of a bearing section of the tool of FIG. 9A.
Figure 9D:
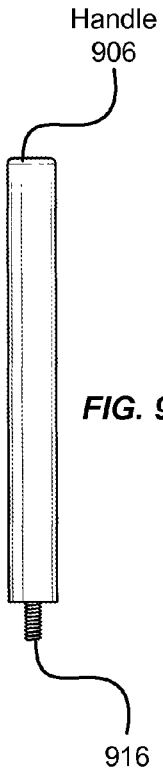
FIG. 9D is a side elevation of a handle of the tool of FIG. 9A.

FIG. 9A is a perspective view of an embodiment of a tool 900 for stretching and removing mesh from the frame 100 of FIG. 1, in accordance with aspects of the invention. The tool 900 includes a gripping section 902, a bearing section 904, and a handle 906. FIG. 9B is a perspective view of the gripping section 902 of the tool of FIG. 9A. FIG. 9C is a perspective view of a bearing section 904 of the tool of FIG. 9A. FIG. 9D is a side elevation of a handle 906 of the tool 900 FIG. 9A. The tool 900 of FIG. 9A-9D is configured for both stretching the mesh 110 on the frame 100 and for removing the movable frame member 104 from the rigid frame 102. However, these functions may be embodied in separate tools.

The gripping section 902, the bearing section 904 and/or the handle 906 may be fabricated using technologies such as extrusion, casting, injection molding, machining, and/or the like. In various embodiments, the gripping section 902, the bearing section 904 and/or the handle 906 are fabricated using materials such as metal, plastic, carbon fiber, and/or the like. Each of the components of the tool 900 may be powder coated for reducing friction and protecting the tool 900 from the environment. The bearing section 904, for example, includes a hanger aperture 912 for suspending the bearing section during powder coating. The bearing section includes an aperture 910 configured to receive the handle 906. In some embodiments, the aperture 910 is threaded and the handle 906 includes threads 916 configured to engage the threaded aperture 910. In various embodiments, the handle is secured to the aperture 910 using a set screw, a pin, a press fit, adhesive, welding, and/or brazing. The gripping section includes a notch 908 configured to accommodate the handle. The handle 906 and the notch 908 may form a cooperative interference to constrain the gripping section 902 from sliding longitudinally along the bearing section 904.

Figure 10:
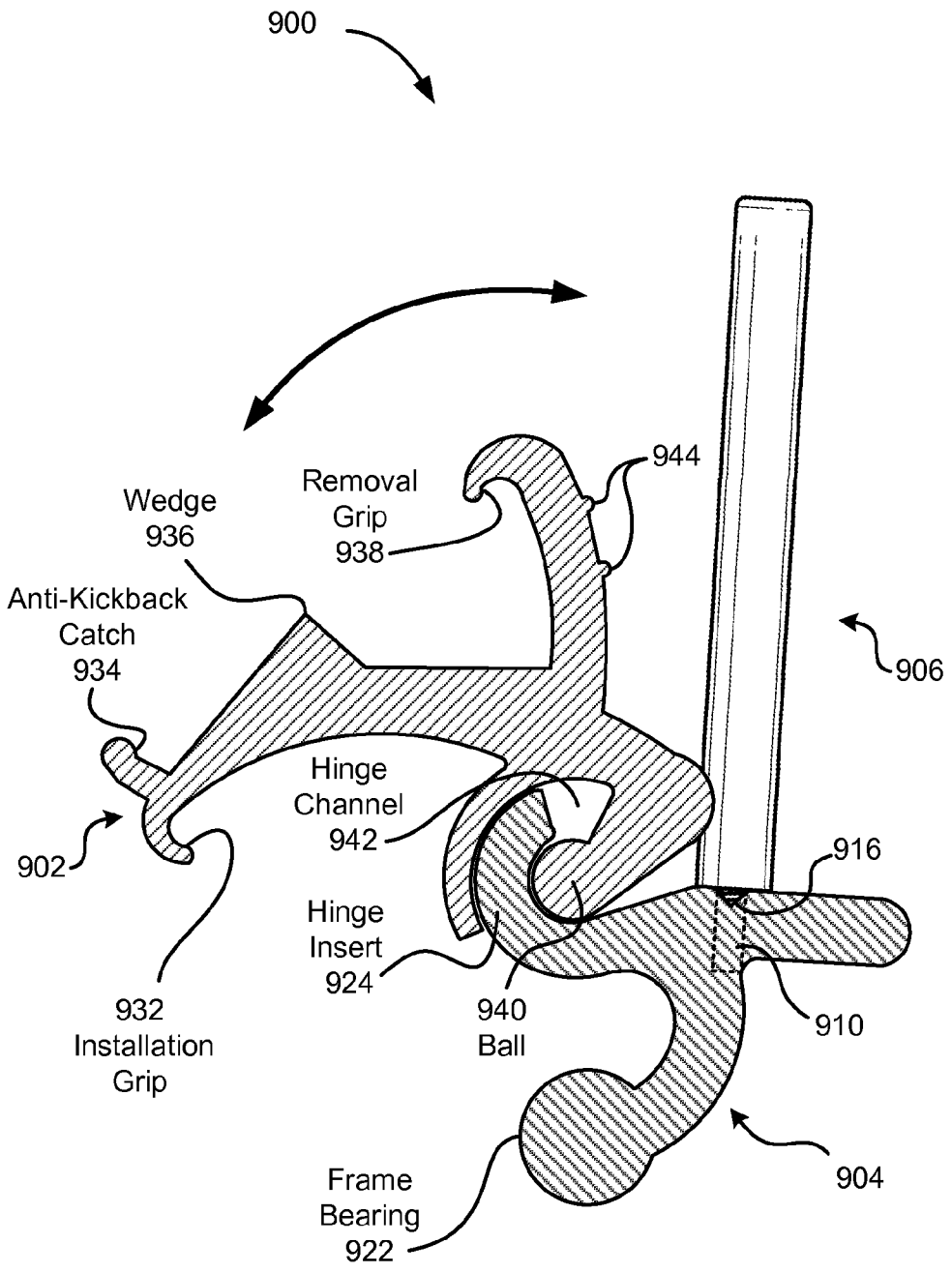
FIG. 10 is an enlarged cross section of the tool of FIG. 9A taken along line d-d, illustrating further details of the tool.
Figure 11:
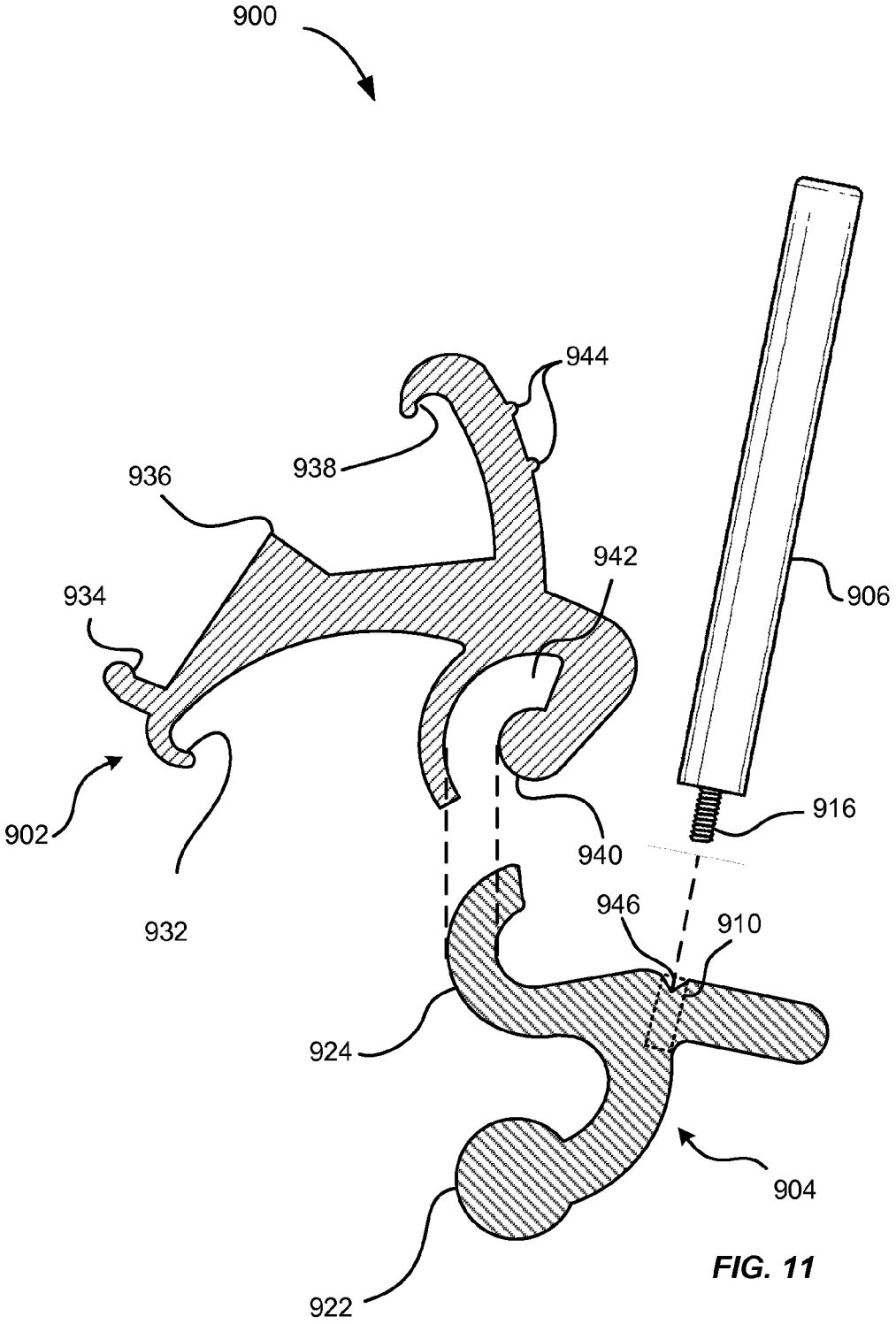
FIG. 11 is an exploded view of the cross section of the tool of FIG. 10.
Figure 12A:
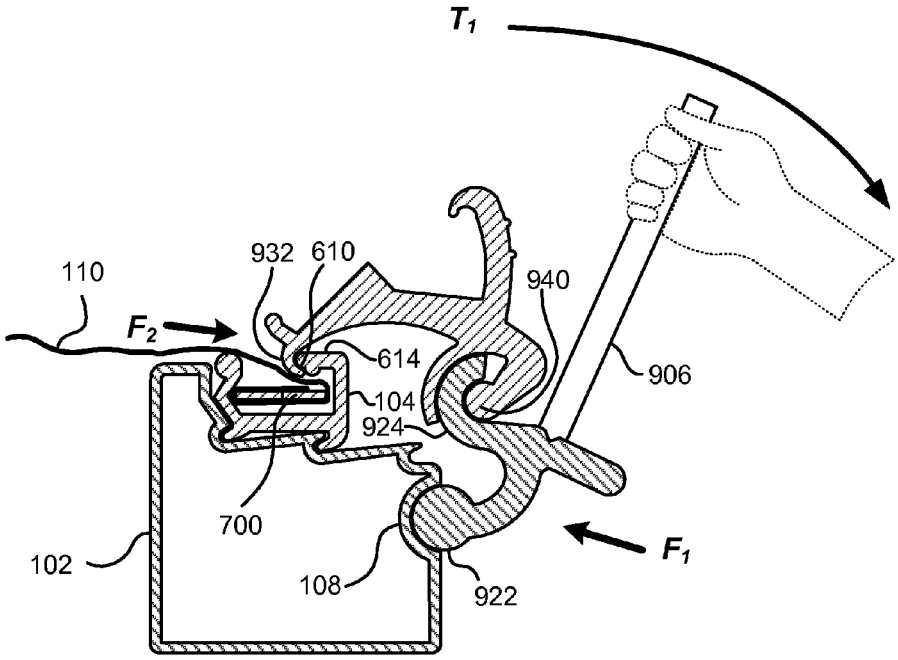
FIGS. 12A-12B are cross sections illustrating use of the tool of FIG. 9A to stretch mesh.
Figure 12B:
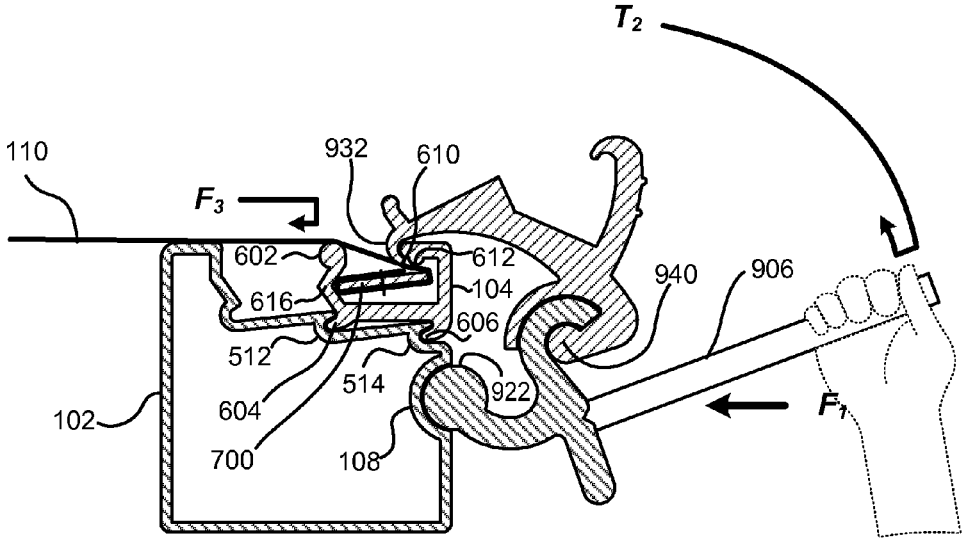

FIG. 10 is an enlarged cross section of the tool 900 of FIG. 9A taken along line d-d, illustrating further details of the tool 900. FIG. 11 is an exploded view of the cross section of the tool 900 of FIG. 10. The gripping section 902 includes an installation grip 932 configured for engaging the engagement surface 610 of the movable frame member 104. The griping section 902 and the bearing section 904 may be coupled using a hinge. The hinge may serve to maintain an engagement angle between the installation grip 932 and the engagement surface 610 during translation of the movable frame member 104. The hinge illustrated for the tool 900 is a ball and socket hinge configured for manufacturability and reducing parts count. The ball and socket hinge of the tool 900 comprises a ball 940, hinge channel 942, and a hinge insert 924. The hinge insert 924 is configured to rotate about the ball 940 within the hinge channel 942. The ball and socket hinge illustrated in FIGS. 10 and 11 is manufacturable using extrusions. The tool 900 also comprises a frame bearing 922 configured to engage the tool bearing surface 108 as illustrated in FIGS. 12A and 12B. The installation grip 932, hinge channel 942, hinge insert 924, ball 940, frame bearing 922, and handle 906 cooperate for applying force to the movable frame member 104 for stretching the mesh 110 on the frame 100 as illustrated in FIGS. 12A and 12B.

Figure 13A:
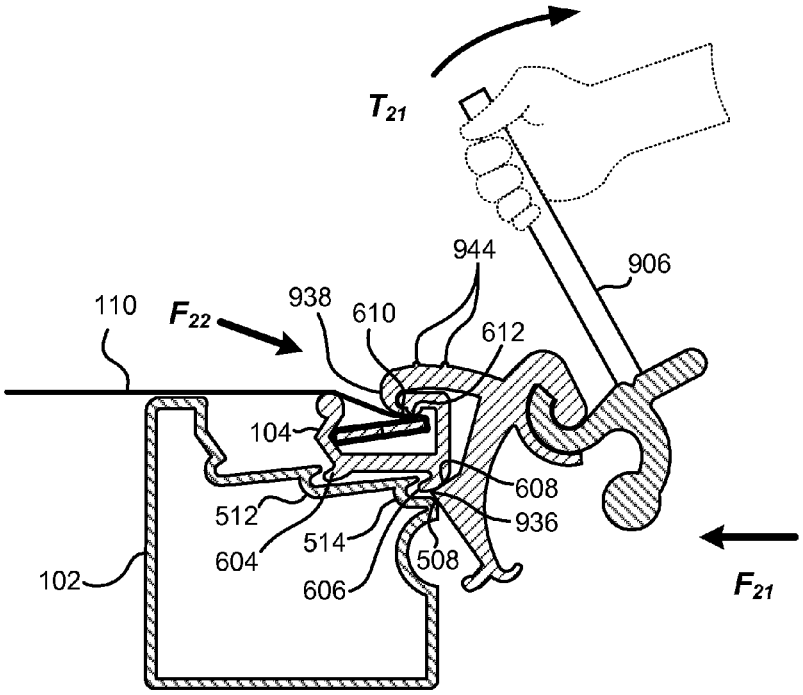
Figure 13B:
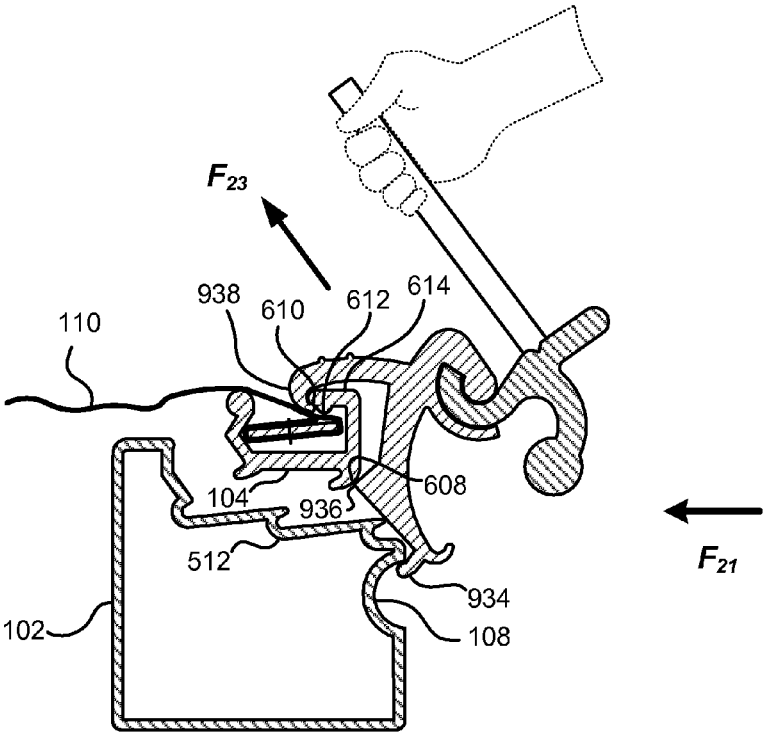
Figure 14A:
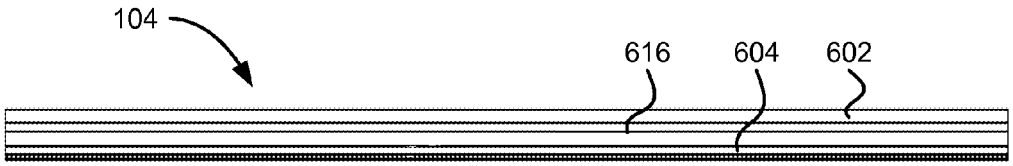
FIGS. 14A-14D are, respectively, a front elevation, a rear elevation, a top plan view, and a bottom plan view of the movable frame member of FIG. 6A.
Figure 14B:
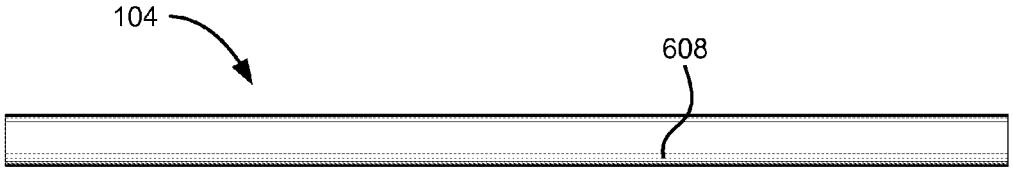
Figure 14C:
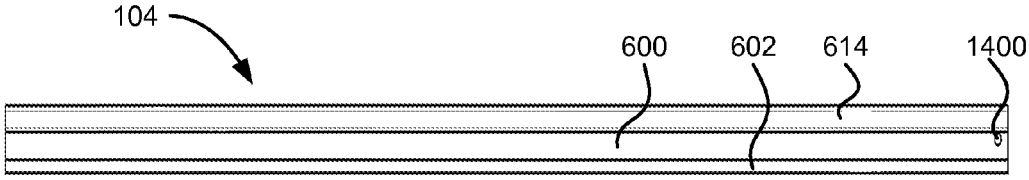
Figure 14D:
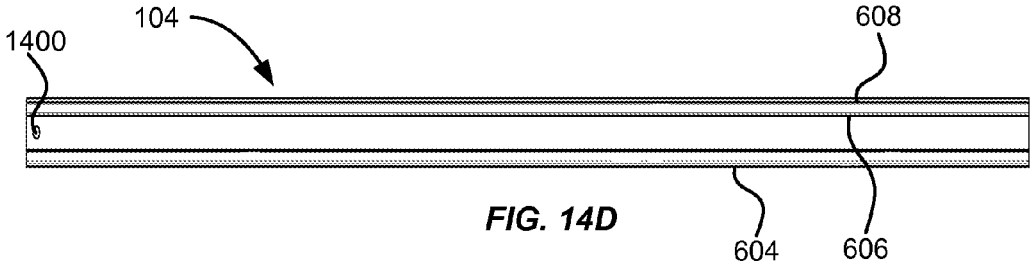

The tool 900 further includes a removal grip 938, wedge 936, an optional anti-kickback catch 934, an optional tapping groove 946, and one or more optional knobs 944. The removal grip is configured to apply force to the movable frame member 104 at the tool engagement surface 610 while the wedge separates the movable frame member 104 from the rigid frame 102, as illustrated in FIGS. 13A-13B. The anti-kickback catch 934 is configured to prevent the movable frame member 104 from launching under force of tension from the mesh 110. The tapping groove 946 simplifies positioning the center of the aperture 910. The knobs 944 provide tactile indicia for indicating orientation of the tool 900, e.g., indicating orientation for either installation or removal of the mesh 110.

FIGS. 12A-12B are cross sections illustrating use of the tool 900 of FIG. 9A to stretch mesh 110. Referring to FIG. 12A, the installation grip 932 engages the tool engagement surface 610. The offset ridge 612 holds the mesh 110 away from the tool engagement surface 610 to reduce tearing of the mesh by the tool 900. The handle 906 may be gripped by hand (not part of the invention) and a torque $T_1$ applied in the direction of the arrow to rotate the handle 906 about the frame bearing 922, which in turn applies a force $F_1$ into the tool bearing surface 108. A force $F_2$ which is about equal and opposite to $F_1$ is applied to the tool engagement surface 610 through the installation grip 932 and the ball and socket hinge (ball 940, hinge insert 924, and hinge channel 942). While a ball and socket hinge is illustrated in FIGS. 12A-13B and described herein, other forms of hinge may be used in place of the ball and socket hinge. The ball and socket hinge serves to maintain the force $F_2$ about horizontal and slightly downward. The force $F_2$ serves to translate the movable frame member 104 to the right and apply tension the mesh 110. The first projection 604 slides across the first step 520 and the second projection 606 slides across the second step 522. The force $F_1$ may include a vertical component and the tool bearing surface 108 provides a vertically constraint to the frame bearing 922 to prevent it from sliding up the rigid frame 102.

Referring to FIG. 12B, as the handle is further rotated, the first projection 604 drops off the edge of the first step 520 and onto the second step 522 and becomes about aligned with the second side groove 512. About simultaneously, the second projection 606 drops off the edge of the second step 522 and becomes about aligned with the third side groove 514. Torque $T_2$ may then be eased as a force $F_3$ urges the first projection 604 to enter the second side groove 512 and the second projection 606 to enter the third side groove 514. The tool 900 may then be used to stretch another side of the frame 100 until all of the sides have been stretched. The force $F_2$ and/or $F_3$ may be applied through about the center and about normal to the longitudinal axis of the movable frame member 104. The force $F_2$ and/or $F_3$ may be applied substantially symmetrically about the center of the locking strip slot 600. The tool bearing surface 108 is illustrated as a longitudinal groove along an external side of the rigid frame 102 and having a substantially semi circular cross section. However, a "V" groove having a cross section of two sides (either of which being straight or curved) may form the tool bearing surface 108. Similarly, a groove having a cross section comprising three, four, five, six, or more sides, any of which being straight or curved may form the tool bearing surface 108.

FIG. 13A-13B are cross sections illustrating use of the tool 900 of FIG. 9A to remove mesh 110. Referring to FIG. 13A, the tool 900 may be oriented with the knobs 944 up to indicate tactilely and/or visually that the tool 900 is configured for removal of the mesh. The removal grip 938 engages the tool engagement surface 610 and the wedge 936 may be placed between the upper separation surface 608 and the lower separation surface 508. A torque T21 may be applied to the handle 906. The torque T21 results in a force F21 on the wedge 936. The force F21 may be divided between the upper separation surface 608 and the lower separation surface 508. Another force F22 is applied to the movable frame member 104. The force F22 urges the first projection 604 out of the second side groove 512 and the second projection 606 out of the third side groove 514. At the same time, the divided force F21 from the wedge 936 lifts the upper separation surface 608 away from the lower separation surface 508.

Referring to FIG. 13B, tension from the mesh 110 applies a force $F_{23}$ which may be greater than $F_{22}$ from the tool 900. When both the first projection 604 and the second projection 606 are clear of the second side groove 512 and the third side groove 514, respectively, the force $F_{23}$ pulls the movable frame member 104 up and away from the rigid frame 102. The wedge 936 lifts the movable frame member 104 clear of the second step 522, thus, the movable frame member 104 is released from the rigid frame 102. Without the side grooves to hold the projections, the tension from the mesh 110 may suddenly exert the force $F_{23}$, which may be much greater than the force $F_{22}$ exerted by the tool 900. The anti-kickback catch 934 is configured to prevent the tool 900 and/or the movable frame member 104 from launching across the room by grabbing the top edge of the tool bearing surface 108 as the tool 900 rapidly accelerates upward. In a similar manner, the tool 900 may be used to release another movable frame member 104 from the rigid frame 102 all or enough of the movable frame members 104 have been released such that the mesh 110 can be removed. The force $F_{22}$ may be applied through about the center and/or substantially symmetrically about the center of the locking strip slot 600, and about normal to the longitudinal axis of the movable frame member 104.

FIGS. 14A-14D are, respectively, a front elevation, a rear elevation, a top plan view, and a bottom plan view of the movable frame member 104 of FIG. 6A. The movable frame member 104 includes an optional aperture 1400 for hanging the movable frame member 104 during finishing, e.g., using paint, powder coat, anodizing, and/or other surface treatment.

Figure 15:
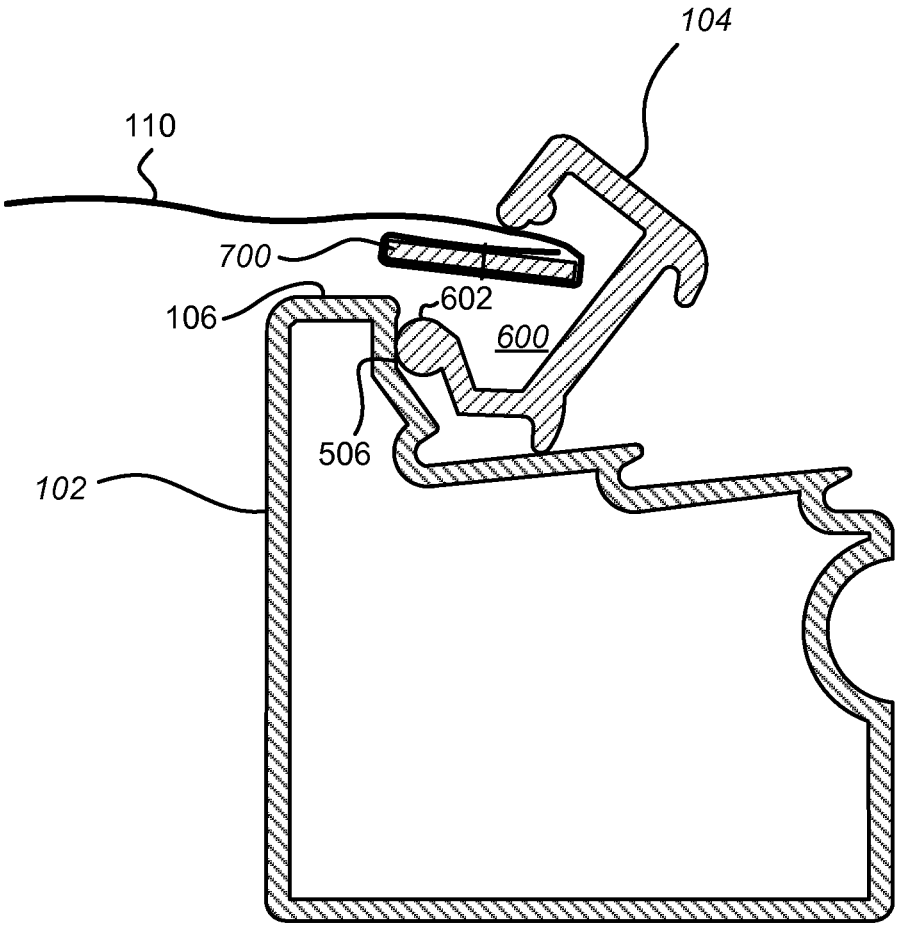
FIG. 15 illustrates an alternative method for loading mesh and a locking strip into the movable frame member.

FIG. 15 illustrates an alternative method for loading mesh 110 and the locking strip 700 into the movable frame member 104. FIG. 15 differs from FIG. 7A and FIG. 8 in that the movable frame member 104 is rotated. The movable frame member 104 may be rotated to an angle of about 40-90 degrees counter clockwise from the illustration of FIG. 8A for placement on the rigid frame 102 and insertion of the locking strip 700 and mesh 110. Upon completing insertion of the locking strip 700, the movable frame member 104 may be rotated clockwise to the orientation of FIG. 8A. The knob 602 is configured for facilitating the clockwise rotation of the movable frame member 104 against holding surface 506. The holding surface 506 is configured for holding the movable frame member 104 during such loading and rotation. The holding surface 506 is further configured for providing a bearing surface for the knob 602 to facilitate manipulation of the movable frame member 104 such as clockwise rotation by hand about the longitudinal axis of the movable frame member 104. The radius of the knob 602 may reduce friction between the holding surface 506 and the knob 620 under moderate tension from the mesh 110.

In some embodiments, the movable frame members 104 may be hollow frame members made from a light weight, non-corrosive material such as aluminum, steel, plastic, and/or the like. The rigid frame 102 may be made from a lightweight non-corrosive material such as aluminum, steel, plastic, and/or the like. In various embodiments, the frame 100 is fabricated using materials such as aluminum, steel, plastic, and/or the like.

Several embodiments are specifically illustrated and/or described herein. However, it will be appreciated that modifications and variations are covered by the above teachings and within the scope of the appended claims without departing from the spirit and intended scope thereof. For example, the rigid frame 102 is described as having side grooves and the movable frame member 104 is described as having projections. However, the rigid frame 102 may have projections and the movable frame member may have grooves. For example, the frame 100 may comprise one, two, three, four, five, six, eight, twelve, or more movable frame members 104. For example, the locking strip 700 is illustrated as having a rectangular cross section, however various embodiments of the locking strip 700 include a cross section that is triangular, triangular with a process, five sided, six sided, seven sided, eight sided, complex curves, and/or the like. (See e.g., U.S. patent application Ser. No. 12/821,154 and 61/312,671) For example, an inverted "T" slot may be disposed in the movable frame member 104 and various configurations of a triangular locking strip may be sized for use in the inverted "T" slot. (See e.g., U.S. patent application Ser. No. 12/821,154 and 61/312,671) In various embodiments, the cross section of the locking strip 700 includes simple and/or complex curves.

The embodiments discussed herein are illustrative. As these embodiments are described with reference to illustrations, various modifications or adaptations of the methods and/or specific structures described may become apparent to persons of ordinary skill in the art. All such modifications, adaptations, or variations that rely upon the teachings of the embodiments, and through which these teachings have advanced the art, are considered to be within the spirit and scope of the present application. Hence, these descriptions and drawings should not be considered in a limiting sense, as it is understood that the present application is in no way limited to only the embodiments illustrated.

What is claimed is:

1. A method for tensioning a screen fabric on a frame, the method comprising:

inserting a locking strip stitched to the screen fabric into a locking strip slot in a movable frame member;

separating a portion of an upper surface of the locking strip slot from the screen fabric using a ridge disposed along the upper surface;

engaging the separated portion of the upper surface using a stretching tool configured for applying a force to the locking strip slot;

applying the force to the locking strip slot using the stretching tool for stretching the screen fabric and translating the movable frame member horizontally from an insertion position to a stretched position; and holding the movable frame member at the stretched position using a rigid frame.

2. The method of claim 1, further comprising supporting the screen fabric in a plane using a substantially continuous ridge disposed between the movable frame member and a printing surface.

3. The method of claim 1, wherein holding the movable frame member at the stretched position comprises inserting a projection on the movable frame member into a groove along an external side of the rigid frame.

4. The method of claim 1, wherein the applied force also vertically translates the movable frame member from the insertion position on a first step down to the stretched position on a second step.

5. The method of claim 1, further comprising separating the movable frame member from the rigid frame using a wedge for removing the screen fabric from the frame.

6. The method of claim 5, further comprising restraining the movable frame member upon separating the movable frame member from the rigid frame using an edge of the rigid frame to engage an anti-kickback catch coupled to the wedge.

7. A method for tensioning a screen fabric on a frame, the method comprising:

inserting a locking strip stitched to the screen fabric into a locking strip slot in a movable frame member;

applying a force to the locking strip slot for stretching the screen fabric and translating the movable frame member horizontally from an insertion position to a stretched position;

holding the movable frame member at the stretched position using a rigid frame; and separating the movable frame member from the rigid frame using a wedge for removing the screen fabric from the frame.

8. The method of claim 7, further comprising supporting the screen fabric in a plane using a substantially continuous ridge disposed between the movable frame member and a printing surface.

9. The method of claim 7, further comprising:

separating a portion of an upper surface of the locking strip slot from the screen fabric using a ridge disposed along the upper surface; and engaging the separated portion of the upper surface using a stretching tool configured for applying the force to the locking strip slot.

10. The method of claim 7, wherein holding the movable frame member at the stretched position comprises inserting a projection on the movable frame member into a groove along an external side of the rigid frame.

11. The method of claim 7, wherein the applied force also vertically translates the movable frame member from the insertion position on a first step down to the stretched position on a second step.

12. The method of claim 7, further comprising restraining the movable frame member upon separating the movable frame member from the rigid frame using an edge of the rigid frame to engage an anti-kickback catch coupled to the wedge.

* * * * *